US009943172B2

(12) United States Patent
Lachenbruch et al.

(10) Patent No.: US 9,943,172 B2
(45) **Date of Patent: *Apr. 17, 2018**

(54) MATTRESS TOPPER WITH VARYING FLOW RESISTANCE

(71) Applicant: Hill-Rom Services, Inc., Batesville, IN (US)

(72) Inventors: Charles A Lachenbruch, Batesville, IN (US); Rachel L Williamson, Batesville, IN (US); Timothy Joseph Receveur, Guilford, IN (US); Christopher R O'Keefe, Columbus, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 239 days.

This patent is subject to a terminal disclaimer.

(21) Appl. No.: 14/805,818

(22) Filed: Jul. 22, 2015

(65) Prior Publication Data

US 2016/0022050 A1 Jan. 28, 2016

Related U.S. Application Data

(63) Continuation of application No. 13/396,224, filed on Feb. 14, 2012, now Pat. No. 9,131,780.

(51) Int. Cl.

| | |
|---|---|
| ***A47C 17/00*** | (2006.01) |
| ***A47C 21/04*** | (2006.01) |
| ***A47C 31/10*** | (2006.01) |

(52) U.S. Cl.

CPC ..... *A47C 21/044* (2013.01); *A47C 21/04* (2013.01); *A47C 21/042* (2013.01); *A47C 21/046* (2013.01); *A47C 31/105* (2013.01)

(58) Field of Classification Search

CPC ..... A47C 21/04; A47C 21/042; A47C 21/044; A47C 21/046; A47C 21/0148; A47C 31/105

See application file for complete search history.

(56) References Cited

U.S. PATENT DOCUMENTS

| | | | |
|---|---|---|---|
| 4,660,388 | A | 4/1987 | Greene, Jr. |
| 5,324,320 | A | 6/1994 | Augustine et al. |

(Continued)

FOREIGN PATENT DOCUMENTS

| | | | |
|---|---|---|---|
| EP | 1987806 | A2 | 11/2008 |
| GB | 2446572 | A | 8/2008 |

(Continued)

OTHER PUBLICATIONS

Response to European Search Report for EP Application 131552653.5 dated Feb. 14, 2014.

(Continued)

*Primary Examiner* — David E Sosnowski

(74) *Attorney, Agent, or Firm* — Barnes & Thornburg LLP

(57) ABSTRACT

A bed comprises a mattress and a topper resting atop the mattress and extending in longitudinal and lateral directions. The topper has a fluid flowpath having an inlet and an outlet. The flowpath exhibits a nonuniform resistance to fluid flow in at least one of the longitudinal and lateral directions. The bed also includes a blower connected to the inlet for supplying air to the flowpath. The resistance may be a monotonically varying resistance to fluid flow in at least one of the longitudinal and lateral directions and configured to preferentially drive fluid flow through the topper so that a larger proportion of the fluid flowing through the topper flows under a target region and a relatively smaller portion bypasses the target region.

20 Claims, 9 Drawing Sheets

(56) References Cited

U.S. PATENT DOCUMENTS

| | | | | |
|---|---|---|---|---|
| 5,817,002 | A | 10/1998 | Donnelly | |
| 6,568,013 | B2 | 5/2003 | Perez | |
| 7,036,163 | B2 | 5/2006 | Schmid | |
| 7,469,432 | B2 | 12/2008 | Chambers | |
| 7,712,164 | B2 | 5/2010 | Chambers | |
| 8,065,763 | B2 | 11/2011 | Brykalski et al. | |
| 8,108,957 | B2 | 2/2012 | Richards et al. | |
| 8,122,545 | B2 | 2/2012 | Wilkinson | |
| 8,181,290 | B2 | 5/2012 | Brykalski et al. | |
| 8,191,187 | B2 | 6/2012 | Brykalski et al. | |
| 8,327,477 | B2 | 12/2012 | Lachenbruch et al. | |
| 8,332,975 | B2 | 12/2012 | Brykalski et al. | |
| 8,418,286 | B2 | 4/2013 | Brykalski et al. | |
| 8,578,527 | B2 | 11/2013 | Lachenbruch | |
| 8,584,279 | B2 * | 11/2013 | Richards | A61G 7/05715 5/600 |
| 8,587,279 | B2 | 11/2013 | Richards et al. | |
| 8,621,687 | B2 | 1/2014 | Brykalski et al. | |
| 8,732,874 | B2 | 5/2014 | Brykalski et al. | |
| 8,756,732 | B2 | 6/2014 | Lachenbruch | |
| 8,782,830 | B2 | 7/2014 | Brykalski et al. | |
| 9,131,780 | B2 * | 9/2015 | Lachenbruch | A47C 21/042 |
| 9,596,945 | B2 * | 3/2017 | Ghanei | A47C 21/044 |
| 2002/0100121 | A1 | 8/2002 | Kocurek | |
| 2004/0234206 | A1 | 11/2004 | Webster et al. | |
| 2004/0237206 | A1 * | 12/2004 | Webster | A47C 21/046 5/727 |
| 2007/0261548 | A1 | 11/2007 | Vrzalik et al. | |
| 2008/0148481 | A1 | 6/2008 | Brykalski et al. | |
| 2009/0013470 | A1 | 1/2009 | Richards et al. | |
| 2010/0011502 | A1 | 1/2010 | Brykalski et al. | |
| 2010/0325796 | A1 | 12/2010 | Lachenbruch et al. | |
| 2011/0068939 | A1 | 3/2011 | Lachenbruch | |
| 2011/0107514 | A1 | 5/2011 | Brykalski et al. | |
| 2011/0247143 | A1 | 10/2011 | Richards et al. | |
| 2011/0258778 | A1 | 10/2011 | Brykalski et al. | |
| 2011/0289684 | A1 | 12/2011 | Parish et al. | |
| 2012/0016281 | A1 | 1/2012 | Richards et al. | |
| 2012/0131748 | A1 | 5/2012 | Brykalski et al. | |
| 2012/0227182 | A1 | 9/2012 | Brykalski et al. | |
| 2013/0086745 | A1 | 4/2013 | Lachenbruch et al. | |
| 2013/0097776 | A1 | 4/2013 | Brykalski et al. | |
| 2013/0198954 | A1 | 8/2013 | Brykalski et al. | |
| 2013/0205506 | A1 | 8/2013 | Lachenbruch et al. | |
| 2013/0212808 | A1 | 8/2013 | Lachenbruch et al. | |
| 2013/0227783 | A1 | 9/2013 | Brykalski et al. | |
| 2013/0269106 | A1 | 10/2013 | Lachenbruch et al. | |
| 2013/0298330 | A1 | 11/2013 | Lachenbruch et al. | |
| 2014/0007346 | A1 | 1/2014 | Lachenbruch | |
| 2014/0013515 | A1 | 1/2014 | Richards et al. | |
| 2014/0041118 | A1 | 2/2014 | Lachenbruch et al. | |
| 2014/0047646 | A1 | 2/2014 | Lachenbruch et al. | |
| 2014/0109319 | A1 | 4/2014 | Wilkinson | |
| 2014/0196216 | A1 | 7/2014 | Weitzel et al. | |
| 2014/0237719 | A1 | 8/2014 | Brykalski et al. | |
| 2016/0022050 | A1 * | 1/2016 | Lachenbruch | A47C 21/042 5/691 |

FOREIGN PATENT DOCUMENTS

| | | | |
|---|---|---|---|
| WO | 2008046110 | A2 | 4/2008 |
| WO | 2011026040 | A1 | 3/2011 |

OTHER PUBLICATIONS

European Search Report for EP Application 14181760.1, dated Oct. 24, 2014; Place of search—Munich; dated Oct. 16, 2014.

European Search Report for Application EP13155265; Place of Search—Munich; dated May 27, 2013.

* cited by examiner

MATTRESS TOPPER WITH VARYING FLOW RESISTANCE

CROSS-REFERENCE TO RELATED APPLICATIONS

This application claims the benefit under 35 U.S.C. § 120 of an earlier filing date of U.S. application Ser. No. 13/396,224, filed Feb. 14, 2012 which is hereby incorporated by reference herein.

TECHNICAL FIELD

The subject matter described herein relates to mattress toppers of the kind used in connection with beds, in particular a microclimate control topper having features for preferentially distributing fluid flowing through the topper to locations where fluid flow is expected to be of most benefit to an occupant of the bed.

BACKGROUND

Microclimate control toppers are typically used in conjunction with the mattresses of beds found in hospitals, nursing homes, other health care facilities, or in home care settings. The topper rests atop the mattress and is secured thereto by, for example, straps, snaps or zippers. A fluid flowpath having an inlet and an outlet extends through the interior of the topper. A pump or similar device supplies a stream of air to the topper so that the air flows into the flowpath by way of the inlet, flows through the flowpath, and exhausts from the flowpath by way of the outlet. The airstream establishes a microclimate in the vicinity of the occupant's skin. Specifically, the airstream helps cool the occupant's skin thereby reducing its nutrient requirements at a time when it is compressed by the occupant's weight and therefore likely to be poorly perfused. The airstream also helps reduce humidity in the vicinity of the occupant's skin thus combatting the tendency of the skin to become moist and soft and therefore susceptible to breakdown.

The need for microclimate control is not uniformly distributed over the occupant's skin. For example skin temperature on the occupant's torso can be considerably higher than skin temperature on the occupant's arms and legs. In addition, nonuniform distribution of sweat glands causes perspiration to accumulate on the skin of the occupant's back and pelvic region. Moreover, many modern beds are profile adjustable. When the bed profile is adjusted the occupant's tissue is exposed to shear which distorts the vasculature and further degrades perfusion. This exacerbates the need for microclimate control.

SUMMARY

The subject matter described herein includes a bed comprising a mattress and a topper resting atop the mattress and extending in longitudinal and lateral directions. The topper has a fluid flowpath having an inlet and an outlet. The flowpath exhibits a nonuniform resistance to fluid flow in at least one of the longitudinal and lateral directions. The bed also includes a blower connected to the inlet for supplying air to the flowpath. The resistance may be a monotonically varying resistance to fluid flow in at least one of the longitudinal and lateral directions and configured to preferentially drive fluid flow through the topper so that a larger proportion of the fluid flowing through the topper flows under a target region and a relatively smaller portion bypasses the target region. The subject matter described herein also includes a topper for a bed, the topper extending in longitudinal and lateral directions and including a fluid flowpath having an inlet and an outlet. The flowpath exhibits a nonuniform resistance to fluid flow in at least one of the longitudinal and lateral directions.

BRIEF DESCRIPTION OF THE DRAWINGS

The foregoing and other features of the variants of the topper described herein will become more apparent from the following detailed description and the accompanying drawings in which.

DETAILED DESCRIPTION

Figure 1:
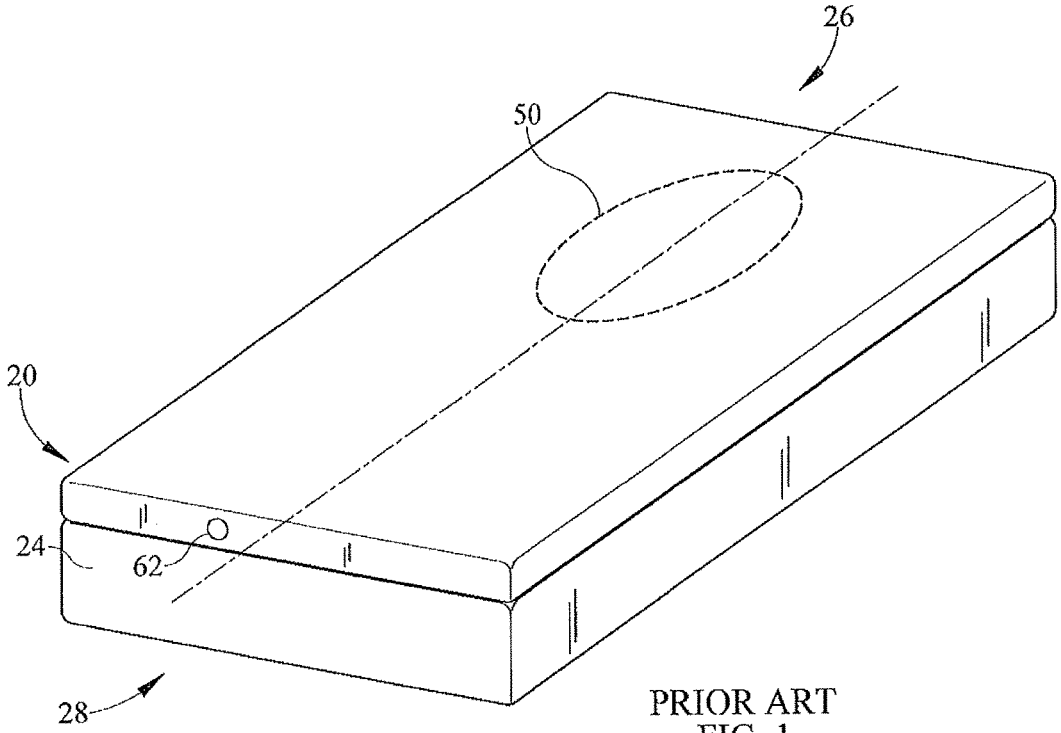
PRIOR ART FIG. 1
FIGS. 1-4 are simplified perspective, plan, side elevation and end elevation views of a mattress and a conventional topper having a fluid flowpath extending therethrough.
Figure 3:
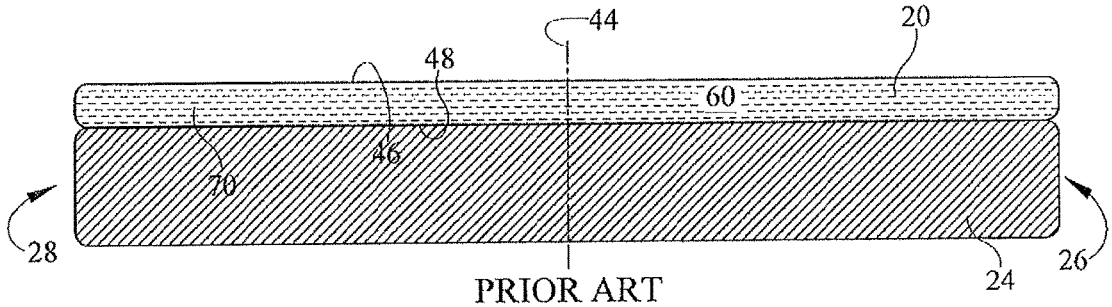
PRIOR ART FIG. 3
Figure 4:
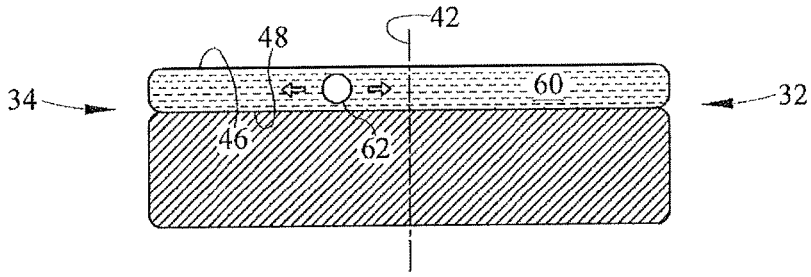
PRIOR ART FIG. 4
Figure 2:
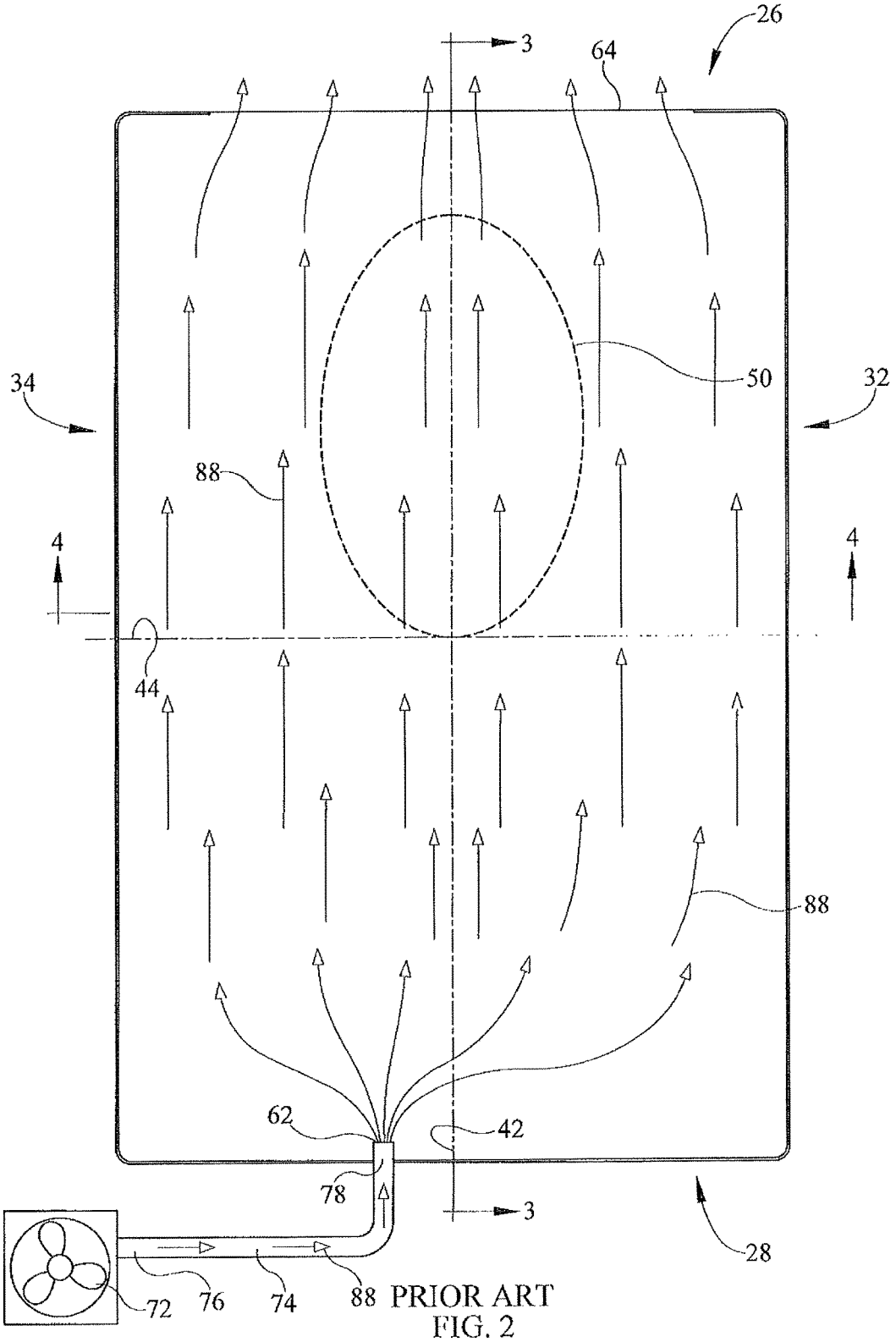
PRIOR ART FIG. 2

FIGS. 1-4 show a conventional topper 20 resting atop a mattress 24. The topper extends longitudinally from a head end 26 to a foot end 28 and spans laterally from a left side 32 to a right side 34. A longitudinally extending centerline 40 and centerplane 42 and a spanwise centerplane 44 are shown for reference. The topper has an upper or occupant side surface 46 and a lower or mattress side surface 48. A target region 50 on upper surface 46 is a region corresponding to a portion of an occupant's body judged to be especially needful of local climate control. The illustrated target region corresponds approximately to the torso of a representative patient lying face up (supine) and centered on the topper. A fluid flowpath 60 having an inlet 62 and an outlet 64 spans laterally across the topper from its left side 32 to its right side 34 and extends longitudinally through the topper. In the illustrated topper inlet 62 is a local inlet port at the foot end of the topper and outlet 64 is a wide vent opening at the head end of the topper. Other inlet and outlet designs may be used.

In the illustrated topper a filler material 70 occupies the flowpath but does not prohibit fluid, particularly air, from flowing through the topper from inlet 62 to outlet 64. Alternatively, the filler material may be absent. A blower 72 or similar device is connected to the inlet by a hose 74 having a blower end 76 and a topper end 78 so that the blower can impel a stream 88 of air to flow through the flowpath. The illustrated topper has no provisions for preferentially directing airstream 88 or any portion thereof to the target region.

Figure 5:
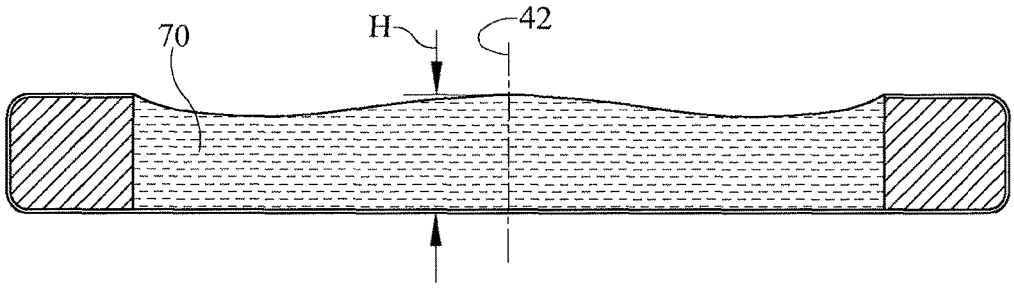
FIGS. 5-8 are end elevation views of variants of a topper as described herein, each exhibiting a spatially nonuniform resistance to fluid flow through the topper as a result of a spatially nonuniform distribution of the properties of a filler material.
Figure 9:
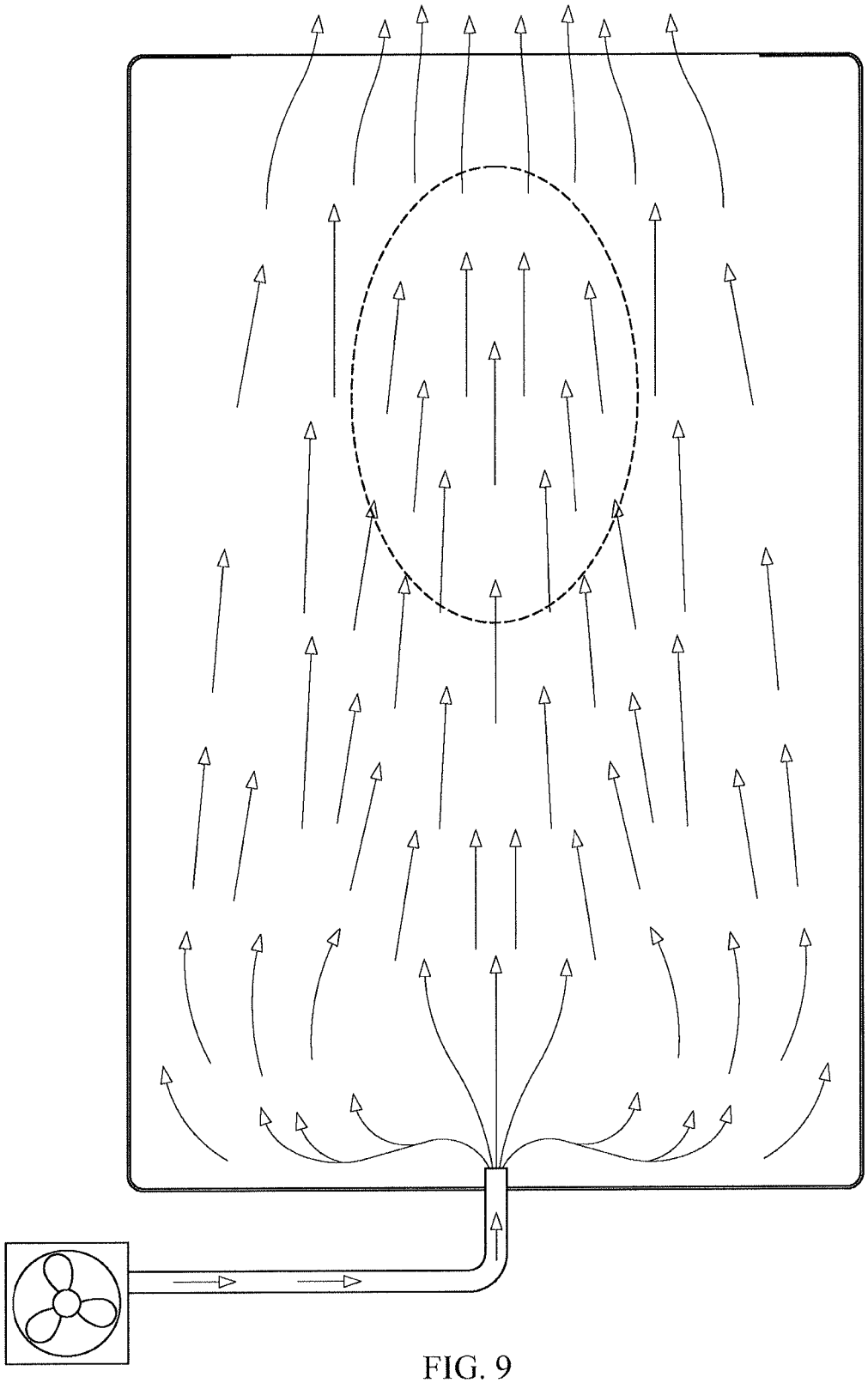
FIG. 9 is a plan view showing a fluid flow pattern representative of the fluid flow pattern attributable to the spatially varying resistance characteristics of the toppers of FIGS. 5-9.

FIG. 5 shows a topper 38 whose flowpath exhibits a purposefully nonuniform resistance to fluid flow, specifically to airflow, in the lateral direction. The nonuniformity arises from a filler material 70 which airstream 88 can flow through from inlet 66 to outlet 64 but whose height H varies laterally. Height H is relatively large at centerplane 42, diminishes with increasing distance from the centerplane and then increases with further increase in distance from the centerplane. Resistance to fluid flow and height H are related monotonically, i.e. as height increases, flow resistance decreases and vice versa. Accordingly, although the dominant direction of fluid flow is the longitudinal direction, a greater proportion of airstream 88 flows under the target region than is the case in the conventional topper of FIGS. 1-4. This is evident by comparing the flow pattern of FIG. 9 to that of FIG. 2.

Figure 6:
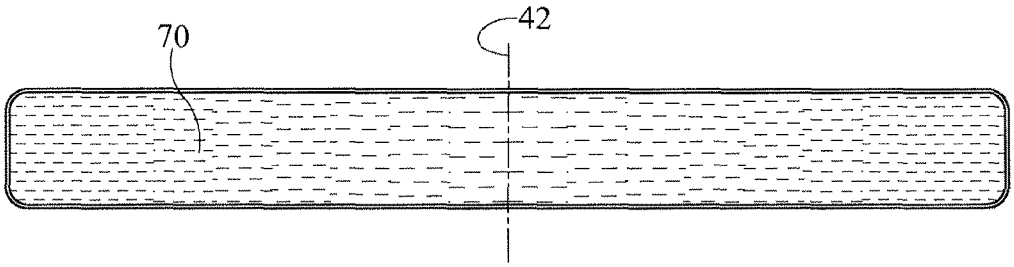

FIG. 6 shows another topper whose flowpath exhibits a purposefully nonuniform airflow resistance in the lateral direction. The nonuniformity arises from a filler material 70 such as a mesh or batting which airstream 88 can flow through from inlet 62 to outlet 64 but whose density varies laterally as signified by the density of the horizontal dashes used to represent the material. The material density is relatively low at centerplane 42 and increases with increasing distance from the centerplane. Resistance to fluid flow and density are related monotonically, i.e. as density increases, flow resistance decreases and vice versa. Accordingly, although the dominant direction of fluid flow is the longitudinal direction, a greater proportion of airstream 88 flows under the target region than is the case in the conventional topper of FIGS. 1-4. This is evident by comparing the flow pattern of FIG. 9 to that of FIG. 2.

Figure 7:
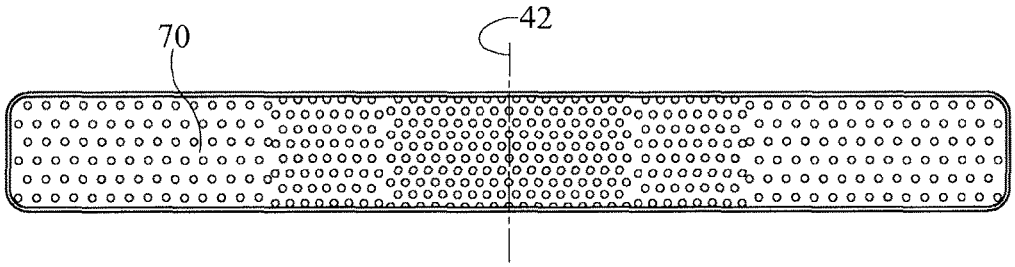

FIG. 7 shows another topper whose flowpath exhibits a purposefully nonuniform airflow resistance in the lateral direction. The nonuniformity arises from a porous filler material 70 which airstream 88 can flow through from inlet 62 to outlet 64 but whose pore density (pore count per unit area) varies laterally. The pore density is relatively high near centerplane 42, and diminishes with increasing distance from the centerplane. Resistance to fluid flow is related monotonically to pore density, i.e. as pore density decreases, flow resistance increases and vice versa. Accordingly, although the dominant direction of fluid flow is the longitudinal direction, a greater proportion of airstream 88 flows under the target region than is the case in the conventional topper of FIGS. 1-4. This is evident by comparing the flow pattern of FIG. 9 to that of FIG. 2.

Figure 8:
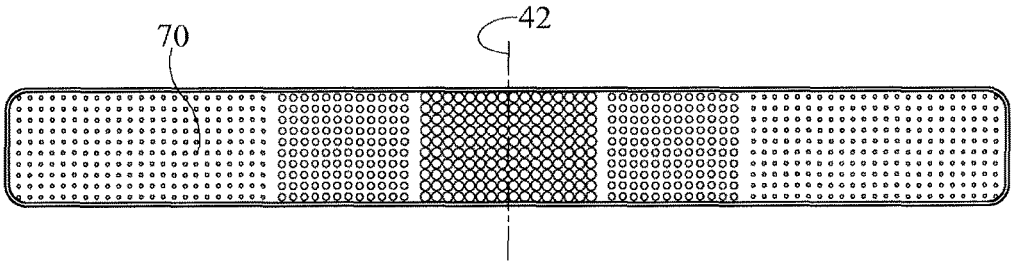

FIG. 8 shows another topper whose flowpath exhibits a purposefully nonuniform airflow resistance in the lateral direction. The nonuniformity arises from a porous filler material 70 which airstream 88 can flow through from inlet 62 to outlet 64, whose pore density is constant in the lateral direction, but whose pore size varies laterally. Pore size is relatively large near centerplane 42, and diminishes with increasing distance from the centerplane. Resistance to fluid flow is related monotonically to pore size, i.e. as pore size decreases, flow resistance increases and vice versa. Accordingly, although the dominant direction of fluid flow is the longitudinal direction, a greater proportion of airstream 88 flows under the target region than is the case in the conventional topper of FIGS. 1-4. This is evident by comparing the flow pattern of FIG. 9 to that of FIG. 2.

Figure 10A:
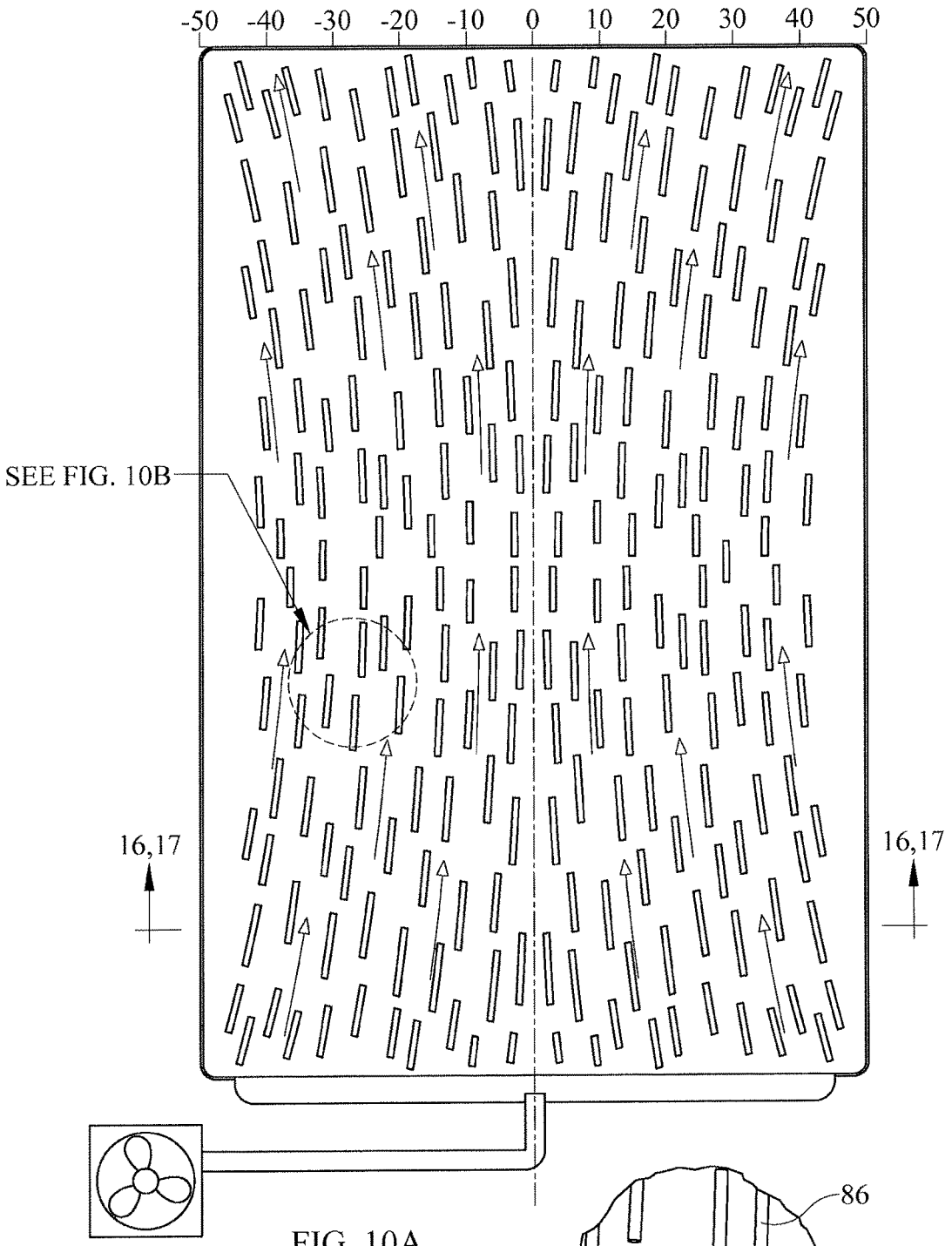
FIG. 10A is a plan view of a variant of a topper as described herein exhibiting a spatially nonuniform fluid flow resistance as the result of pores or tubules in a filler material which are locally oriented to encourage an airstream to flow in a desired direction and impede it from flowing in other directions.
Figure 10B:
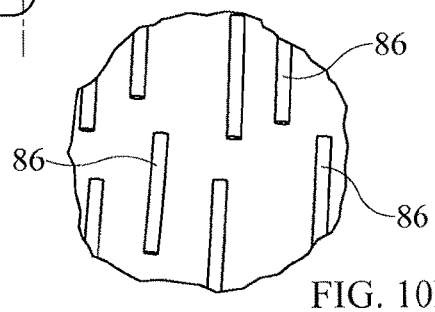
FIG. 10B is an enlarged view of a portion of FIG. 10A enclosed in the dotted circle shown in FIG. 10A.

FIG. 10 shows another topper whose flowpath exhibits a purposefully nonuniform airflow resistance in the lateral direction. The nonuniformity arises from a filler material 70 having flow directing features such as tubules 86 (illustrated) fibers or high aspect ratio (high length/diameter ratio) pores having a length sufficient to influence the direction of fluid flow and which are oriented to encourage the airstream to flow in a desired direction and impede it from flowing in other directions.

Combinations of varying height, material density, pore density, pore size, pore or tubule or fiber orientation and other properties affecting resistance to fluid flow can be used to achieve the above described spatial variation in airflow resistance.

Figure 11:
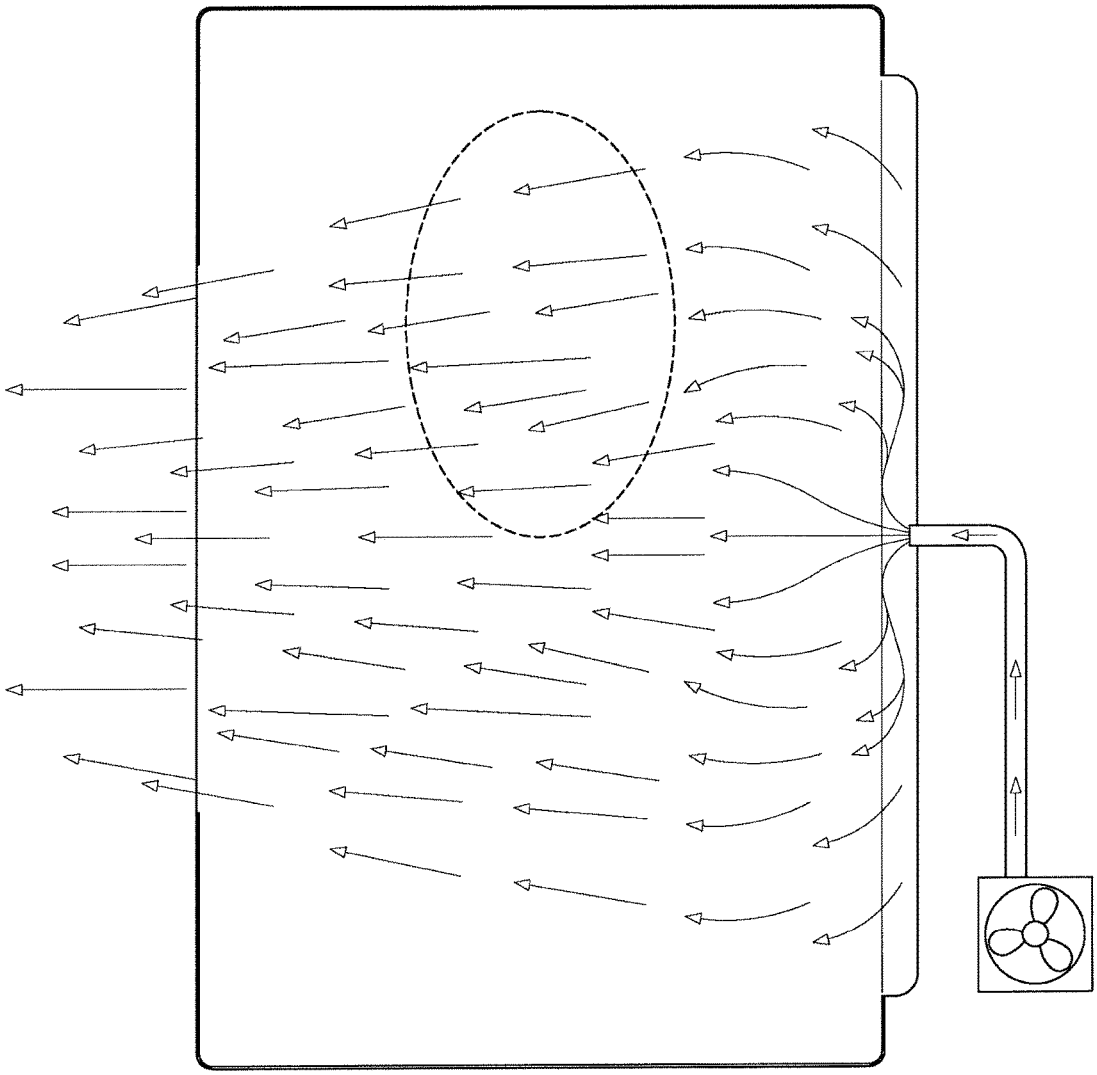
FIG. 11 is a plan view similar to that of FIG. 9 showing a fluid flow pattern attributable to longitudinally nonuniform fluid flow resistance rather than the laterally nonuniform resistance of FIGS. 5-8.
Figure 12:
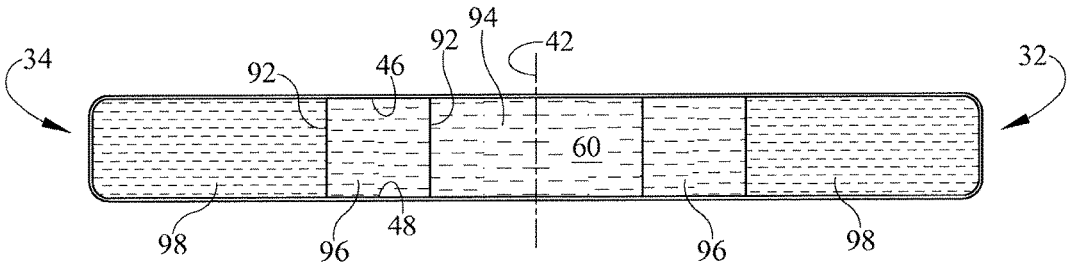
FIGS. 12-14 are views similar to those of FIGS. 6-8 in which partitions divide the flowpath into channels.
Figure 13:
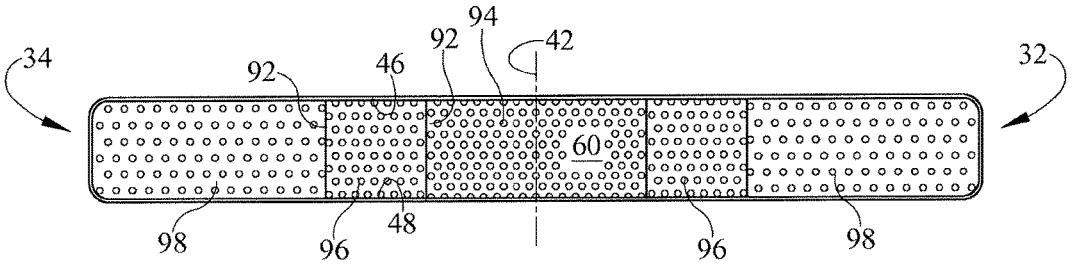

In the foregoing examples the dominant direction of airflow is the longitudinal direction, although it will be appreciated that because of the laterally varying resistance to airflow (i.e. resistance variation perpendicular to the the dominant direction of fluid flow) the fluid streamlines also have a lateral directional component to preferentially drive a relatively larger proportion of the airstream to flow under the target region and a relatively smaller portion to bypass the target region. Alternatively, as seen in FIG. 11, the dominant direction of airflow can be the lateral direction with the fluid streamlines having a more modest longitudinal directional component for preferentially driving a relatively larger proportion of the airstream to flow under the target region and a relatively smaller portion to bypass the target region. In general the resistance varies spatially in a direction substantially perpendicular to a dominant fluid flow direction through the flowpath.

Because the target region is a region corresponding to the torso of an occupant approximately laterally centered on the topper, the flowpaths of the toppers of FIGS. 5-11 exhibit a resistance gradient across the target region such that airflow resistance is lower at relatively more inboard locations and higher at relatively more outboard locations. That is, resistance is relatively lower near centerplane 42 or 44 and increases with proximity to the sides 32, 34 or the head and foot ends 26, 28.

Figure 14:
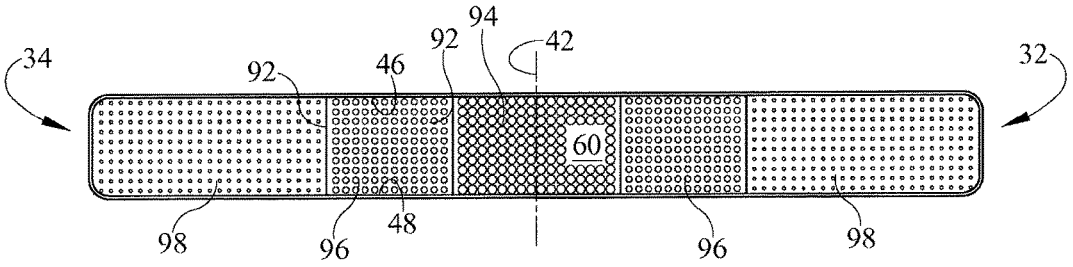
Figure 15:
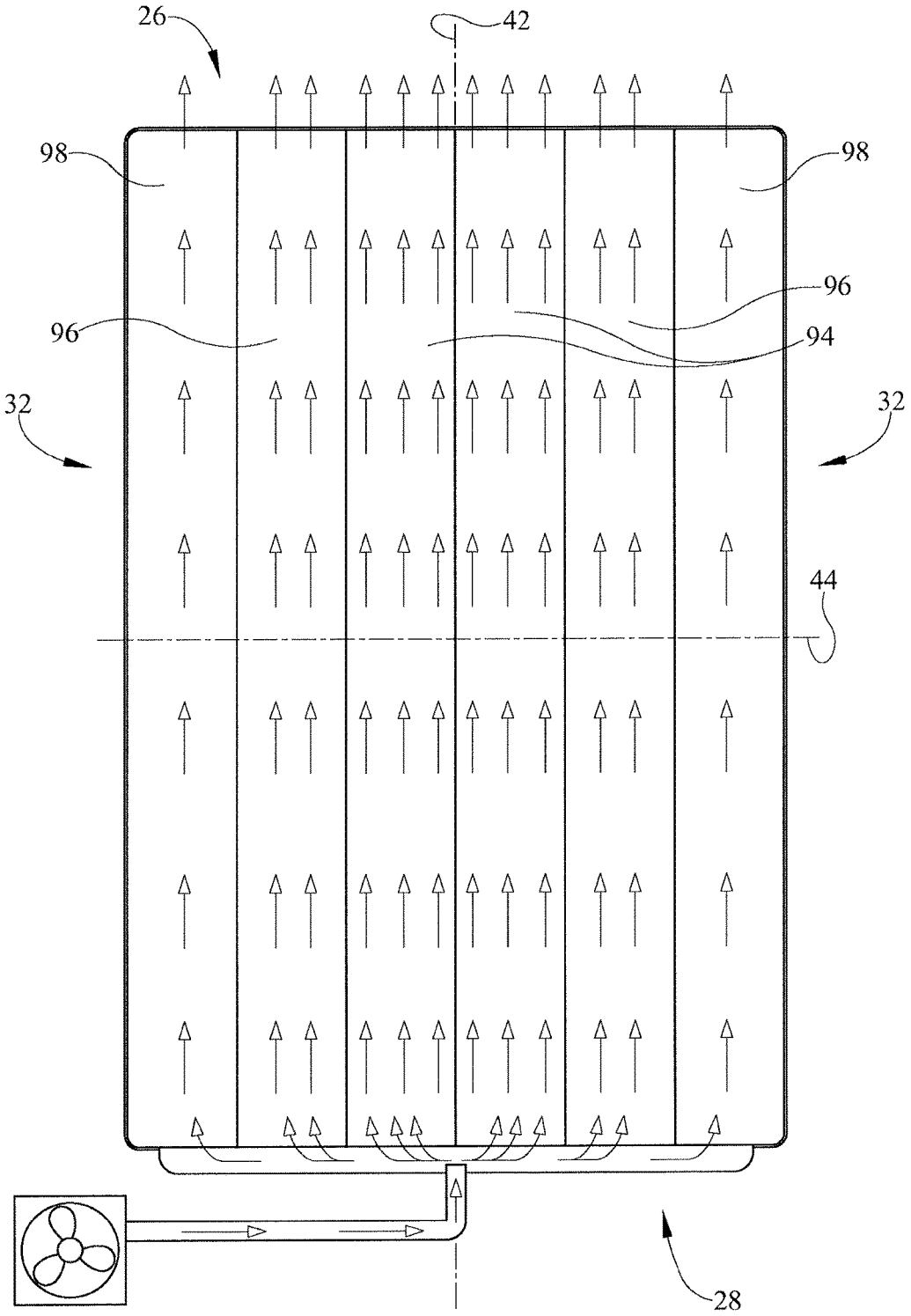
FIG. 15 is a plan view showing a fluid flow pattern representative of the fluid flow pattern attributable to the spatially varying resistance characteristics of the toppers of FIGS. 12-14.

FIGS. 12-14 and 15 illustrate toppers similar to those of FIGS. 6-8 but with longitudinally extending, laterally distributed partitions 92 joined to upper and lower topper surfaces 46, 48. The partitions divide flowpath 60 into longitudinally extending, laterally distributed parallel flow passages each occupied by a filler material. The four dividers in each illustration divide the flowpath into an inboard passage 94, a pair of intermediate passages 96 flanking the inboard passage, and a pair of outboard passages 98 each laterally between an intermediate passage and either the left or right side of the topper. The filler material is selected to impart a relatively low fluid flow resistance to the inboard passage, an intermediate fluid flow resistance to the intermediate passages and a relatively high fluid flow resistance to the outboard passages. These flow resistances are achieved with low, medium and high material density (FIG. 12) high, medium and low pore density (FIG. 13) and large, medium and small pore size (FIG. 14). Thus, airflow resistance differs from passage to passage but in a given passage is constant in the direction in which the passages are distributed, i.e. in the lateral direction. Alternatively a laterally nonuniform flow resistance can be established across each passage if desired. In addition although the illustrated passages are co-flowing passages (fluid flows from the foot end toward the head end in all passages) counter flowing passages can be employed. For example passages 94 and 98 could receive from inlets at their respective foot ends while passages 96 could receive air from an inlet at their head ends. In all cases each passage would have an outlet at its opposite end for exhausting the air.

As already noted in connection with the nonpartitioned embodiments of FIGS. 5-10 the dominant direction of fluid flow can be lateral rather than longitudinal. Similarly, the partitions of the partitioned embodiments of FIGS. 12-14 can be oriented so that they extend laterally and are distributed longitudinally with the result that the dominant direction of fluid flow is lateral rather than longitudinal. In general the passages extend in one direction (longitudinal or lateral) and are spatially distributed in the other direction (lateral or longitudinal) and the flow resistance differs from passage to passage but is constant in any given passage in the direction of passage distribution. Alternatively a nonuniform flow resistance can be established across each passage in the direction of passage distribution if desired.

Figure 16:
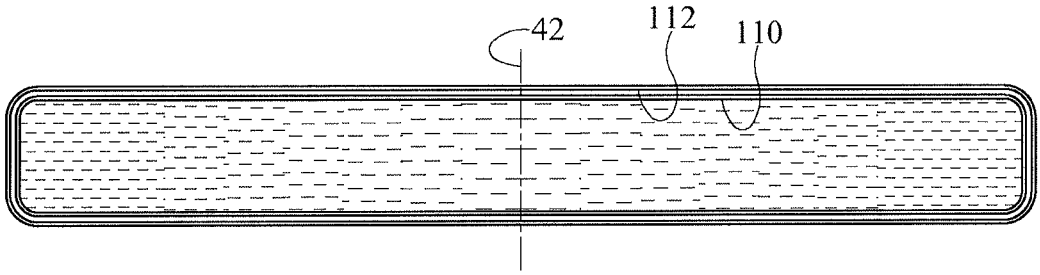
FIGS. 16-17 are end elevation views showing an alternate topper construction comprising an insert and a cover or ticking.
Figure 17:
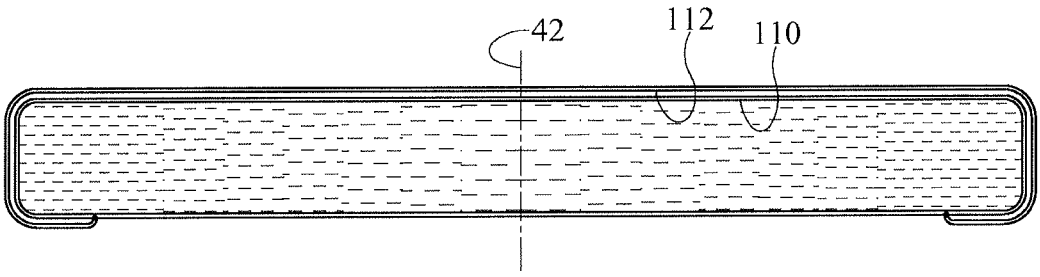

FIGS. 16-17 shows a possible variation on the construction of the topper. The toppers of FIGS. 16-17 each comprise an insert 110 which exhibits the nonuniform resistance and a cover or ticking 112 that covers the insert. In FIG. 16 the ticking encloses the insert by circumscribing it. In FIG. 17 the ticking covers the insert but does not enclose it as in FIG. 16.

Although this disclosure refers to specific embodiments, it will be understood by those skilled in the art that various changes in form and detail may be made without departing from the subject matter set forth in the accompanying claims.

We claim:

1. A topper for a bed, the topper extending in longitudinal and lateral directions and including a longitudinal fluid flowpath defined by an inlet and an outlet, the longitudinal flowpath traversing a material that has a first resistance to fluid flow at a longitudinal plane and monotonically increasing resistance to fluid flow in the lateral directions away from the longitudinal plane to a point of second resistance to fluid flow on one side of the plane, the second resistance higher than the first resistance, and a point of third resistance on the opposite side of the plane, the third resistance higher than the first resistance.

2. The topper of claim 1 wherein the increasing resistance has a gradient such that the increasing resistance in a target region of the topper is lower at relatively more inboard locations of the topper and higher at relatively more outboard locations.

3. The topper of claim 1 in which the flowpath includes fluid flow passages distributed across one of the directions and extending along the other of the directions.

4. The topper of claim 3 in which the increasing resistance differs from passage to passage and is constant in a given passage in the direction of passage distribution from passage to passage.

5. The topper of claim 1 in which the variation in resistance is attributable to a spatially varying material height.

6. The topper of claim 1 in which the variation in resistance is attributable to a spatially varying material density.

7. The topper of claim 1 in which the variation in resistance is attributable to a spatially varying porosity.

8. The topper of claim 7 in which the spatially varying porosity is attributable to a spatially varying pore density.

9. The topper of claim 7 in which the spatially varying porosity is attributable to a spatially varying pore size.

10. The topper of claim 1 in which the variation in resistance is a flow directing feature.

11. The topper of claim 1 wherein the material comprises tubules that form a flow directing feature.

12. The topper of claim 1 comprising an insert which exhibits the variation in resistance and a ticking that covers the insert.

13. The topper of claim 1 comprising an insert which exhibits the variation in resistance and a ticking that encloses the insert.

14. A bed comprising:

a mattress a topper extending in longitudinal and lateral directions and including a longitudinal fluid flowpath defined by an inlet and an outlet, the longitudinal flowpath traversing a material that has a first resistance to fluid flow at a longitudinal plane and monotonically increasing resistance to fluid flow in the lateral directions away from the longitudinal plane to a point of second resistance to fluid flow on one side of the plane, the second resistance higher than the first resistance, and a point of third resistance on the opposite side of the plane, the third resistance higher than the first resistance; and a blower connected to the inlet for supplying air to the flowpath.

15. The topper of claim 14 wherein the increasing resistance has a gradient such that the increasing resistance in a target region of the topper is lower at relatively more inboard locations of the topper and higher at relatively more outboard locations.

16. The topper of claim 14 in which the flowpath includes fluid flow passages distributed across one of the directions and extending along the other of the directions.

17. The topper of claim 16 in which the increasing resistance differs from passage to passage and is constant in a given passage in the direction of passage distribution from passage to passage.

18. The topper of claim 14 in which the variation in resistance is attributable to a spatially varying material height.

19. The topper of claim 14 in which the variation in resistance is attributable to a spatially varying material density.

20. The topper of claim 14 in which the variation in resistance is attributable to a spatially varying porosity.

* * * * *